US006813826B2

(12) United States Patent
Ito et al.

(10) Patent No.: US 6,813,826 B2
(45) Date of Patent: Nov. 9, 2004

(54) TERMINAL CRIMPING DIES

(75) Inventors: Naoki Ito, Shizuoka (JP); Hironori Kitagawa, Shizuoka (JP); Tsutomu Takayama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 156 days.

(21) Appl. No.: 10/166,747

(22) Filed: Jun. 12, 2002

(65) Prior Publication Data

US 2002/0189095 A1 Dec. 19, 2002

(30) Foreign Application Priority Data

Jun. 13, 2001 (JP) ..... P2001-178217

(51) Int. Cl.[7] ..... H01R 43/042

(52) U.S. Cl. ..... 29/753; 29/748; 29/750; 29/751

(58) Field of Search ..... 29/748, 750, 751, 29/753, 860; 439/874; 179/94 R, 94 C

(56) References Cited

U.S. PATENT DOCUMENTS

| | | | | |
|---|---|---|---|---|
| 3,098,517 A | | 7/1963 | Zimmerman et al. | |
| 4,966,565 A | * | 10/1990 | Dohi | 439/874 |
| 5,025,554 A | * | 6/1991 | Dohi | 29/860 |
| 5,486,653 A | | 1/1996 | Dohi | |

* cited by examiner

*Primary Examiner*—Carl J. Arbes
(74) *Attorney, Agent, or Firm*—Sughrue Mion, PLLC

(57) ABSTRACT

It is a terminal crimping die system for crimping a terminal to an electric wire by fitting an anvil, in which a terminal receiving groove is provided in a crimping face part, into a recess of a crimper. In this terminal crimping die system, the width of each of receiving surfaces, each of which is provided between a corresponding one of both end parts of the terminal receiving groove and a corresponding one of both end parts of the crimping face part, is not more than ½ of the thickness of the terminal.

5 Claims, 4 Drawing Sheets

TERMINAL CRIMPING DIES

The present application is based on Japanese Patent Application No. 2001-178217, which is incorporated herein by reference.

BACKGROUND OF THE INVENTION

This invention relates to a terminal crimping die system for crimping and connecting a terminal to an electric wire.

A terminal crimping machine is operative to crimp a terminal to an end part of an electric wire. There has been provided a conventional terminal crimping machine that uses a crimping die system consisting of a crimper (or upper die) 10 and an anvil (or lower die) 11, as shown in FIG. 4.

The crimper 10 has a recess 13 opened toward the anvil 11, and is provided in such a way as to be able to move along the direction of gravity.

The anvil 11 is disposed under the crimper 10, and formed in such a way as to have a section shaped so that the anvil 11 can be fitted into the recess 13 of the crimper 10. The top surface of the anvil 11 is formed as a crimping face 14. A curved terminal receiving groove 14*a,* on which a terminal 15 is put, is provided in this crimping face part 14. The terminal 15 having a U-shaped section, in which a conductor is accommodated, is placed on the terminal receiving groove 14*a*. When the crimper 10 is lowered and both the anvil 11 and the crimper 10 vertically press the terminal 15, respectively, both the end parts of the terminal 15 each having a top part, which comes into contact with a wall of the recess, gradually and upwardly go along the walls, so that the end parts are inwardly pushed and then bent. Thus, as shown in FIG. 6, the terminal 15 encloses the conductor and is crimped and caulked onto the conductor in such a way as to dig thereinto.

Meanwhile, as shown in FIGS. 4 and 5, the anvil 11 is provided with the terminal receiving groove 14*a* so that each of both end parts of the groove 14*a* is spaced from a corresponding one of both the end parts of the crimping face 14 toward the center thereof. That is, each of receiving surfaces 14*b* each extending along a direction nearly perpendicular to a direction, in which the anvil 11 is fitted, is provided between a corresponding one of both end parts of the terminal receiving groove 14*a* and that of both end parts of the crimping face 14. This is configured by taking the durability of the anvil 11 into consideration. However, when the terminal 15 to be crimped is small, the (plate) thickness thereof is small and sometimes almost similar to the width b of each of the receiving surfaces 14*b*.

When the plate thickness of the terminal 15 is comparable to the width b of each of the receiving surfaces 14*b,* and the terminal 15 is crimped onto the wire in this way, stress is concentrated on a part of the crimped terminal 15 (that is, a part B shown in FIG. 6). That is, when the terminal is crimped, a caulking force f is generated in each crimped part, the receiving surface 14*b* bears the caulking force f generated in the vicinity thereof, so that the stress is concentrated on a part of the crimped terminal 15 (that is, the part B shown in FIG. 6). Practically, for example, when a terminal having a terminal plate thickness of 0.25 mm is crimped by using 0.22-mm-wide receiving surfaces, stress is concentrated on a part of the crimped terminal 15 (that is, the part B shown in FIG. 6). When stress is concentrated on a part of the terminal 15, the durability of the terminal 15 may be degraded. Moreover, the electrical connecting performance thereof may be deteriorated. Furthermore, sometimes, the terminal 15 is not favorably connected to the wire.

Accordingly, the invention is accomplished in view of such circumstances. An object of the invention is to provide a terminal crimping die system enabled to favorably crimp a terminal to an electric wire without concentrating stress on a part of the terminal.

SUMMARY OF THE INVENTION

To achieve the foregoing object, according to the invention, there is provided a terminal crimping die system comprising: a crimper including a recess; an anvil provided with a crimping face including a terminal receiving groove and a pair of receiving surfaces, each of which is formed between an end part of the terminal receiving groove and an end part of the crimping face, the anvil being configured to be inserted into the recess of the crimper to thereby crimp and connect a terminal to an electric wire; wherein a width of the receiving surface is not more than ½ of a thickness of the terminal.

Preferably, the width of each of the receiving surfaces ranges from ⅕ to ⅖ of the thickness of the terminal.

With such a configuration, when the terminal is crimped, a caulking force is generated in each crimping part, the caulking force generated in the vicinity thereof partly acts in a direction toward the inside of the terminal receiving groove and is deconcentrated. This prevents the stress from being concentrated on a part of the terminal (that is, a part A shown in FIG. 3), and enables the favorable crimp-connection of the terminal to an electric wire.

Further, in the present invention, a terminal crimping method comprising the steps of:

providing a crimper including a recess and an anvil provided with a crimping face including a terminal receiving groove and a pair of receiving surfaces, each of which is formed between an end part of the terminal receiving groove and an end part of the crimping face;

putting a terminal on the crimping face; and inserting the anvil into the recess of the crimper, so that the terminal is crimped to an electric wire;

wherein a width of the receiving surface is not more than ½ of a thickness of the terminal.

Preferably, the width of the receiving surface may range from ⅕ to ⅖ of the thickness of the terminal.

DETAILED DESCRIPTION OF THE PREFERRED EMBODIMENTS

Hereinafter, an embodiment of the invention is described hereinbelow with reference to the accompanying drawing.

Figure 1:
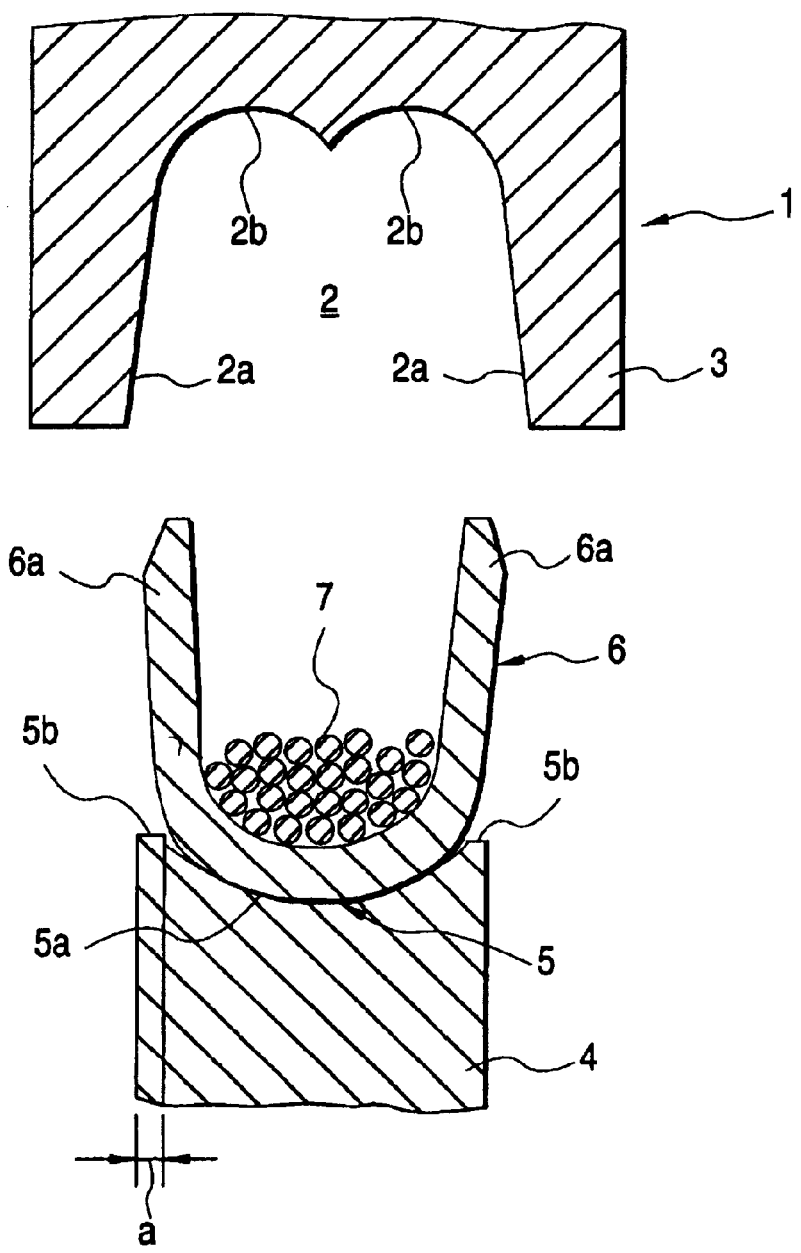
FIG. 1 is a sectional view showing an example of a terminal crimping die system of the invention.
Figure 2:
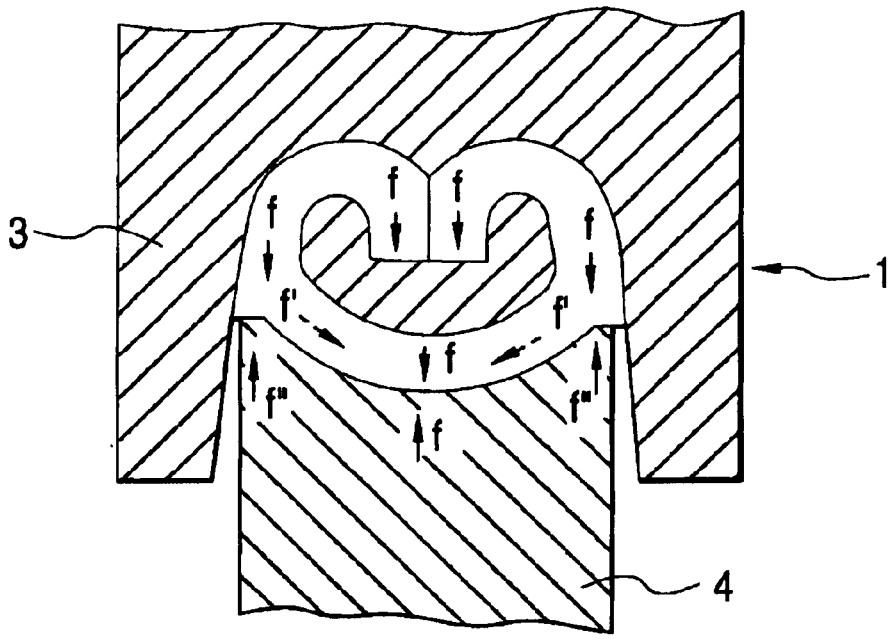
FIG. 2 is a sectional view showing a condition in which a terminal is crimped by the terminal crimping die system of the invention.

FIGS. 1 and 2 are views each showing a terminal crimping die system of the invention. In FIGS. 1 and 2, reference numeral 1 designates a terminal crimping die system. This terminal crimping die system 1 consists of a crimper (or upper die) 3, which has a recess 2, and an anvil (or lower die) 4 disposed under the crimper 3.

The crimper 3 has a recess 2, which is opened in the downward direction of weight, and is provided in such a manner as to be able to move along the direction of gravity. The recess 2 has a shape that is nearly bilaterally symmetric with respect to a center line thereof. Practically, the recess 2 is constituted by guide walls 2*a,* which are shaped so that the lateral distance therebetween is increased toward the anvil 4, and crimping walls 2*b,* which are respectively continued from the guide walls 2*a* and shaped like curved surfaces. That is, the recess 2 is shaped nearly like a reverse W.

The anvil 4 is disposed in the direction of gravity, that is, under the recess 2 of the crimper 3, and formed in such a way as to have a section shaped so that the anvil 4 can be fitted into the recess 2 of the crimper 3. The top surface of the anvil 4 is formed as a crimping face 5. A terminal receiving groove 5*a,* on which a terminal 6 is put, is provided in this crimping face part 5. The terminal receiving groove 5*a* is used by putting the terminal 6 thereon to thereby perform positioning of the terminal 6. The shape of the terminal receiving groove 5*a* is not limited to a specific one. As shown in the figure, the terminal receiving groove 5*a* may be shaped like a curved groove. Alternatively, the terminal receiving groove 5*a* may be formed in such a way as to have another shape like a letter, for example, "V".

Both end parts of the terminal receiving groove 5*a* are placed at a predetermined distance from end parts of the crimping face 5 toward the center thereof, respectively. Each of receiving surfaces 5*b* each extending along a direction (that is, a horizontal direction) nearly perpendicular to a direction (that is, the downward direction of gravity), in which the anvil 4 is fitted, is provided between a corresponding one of both end parts of the terminal receiving groove 5*a* and that of both end parts of the crimping face 5. That is, the crimping face 5 is constituted by the receiving surfaces 5*b* and the terminal receiving groove 5*a*.

The width of each of the receiving surfaces 5*b* (that is, the length between the corresponding one of both end parts of the terminal receiving groove 5*a* and that of both end parts of the crimping face 5) a is set at a length at which the force generated in the vicinity of the receiving surface 5*b* during crimping the terminal 6 is deconcentrated. Practically, the width a of each of the receiving surfaces 5*b* is not more than ½ of the (plate) thickness of the terminal 6. Preferably, the width a of each of the receiving surfaces 5*b* is set at a length ranging from ⅕ to ⅖ of the plate thickness of the terminal 6.

Meanwhile, to crimp the terminal 6 by using this terminal crimping die system, first, as shown in FIG. 1, the terminal 6, which accommodates conductors 7 of electric wires between crimping pieces 6*a* and 6*a* and has a U-shaped section, is put on the terminal receiving groove 5*a* of the anvil 4.

Figure 3:
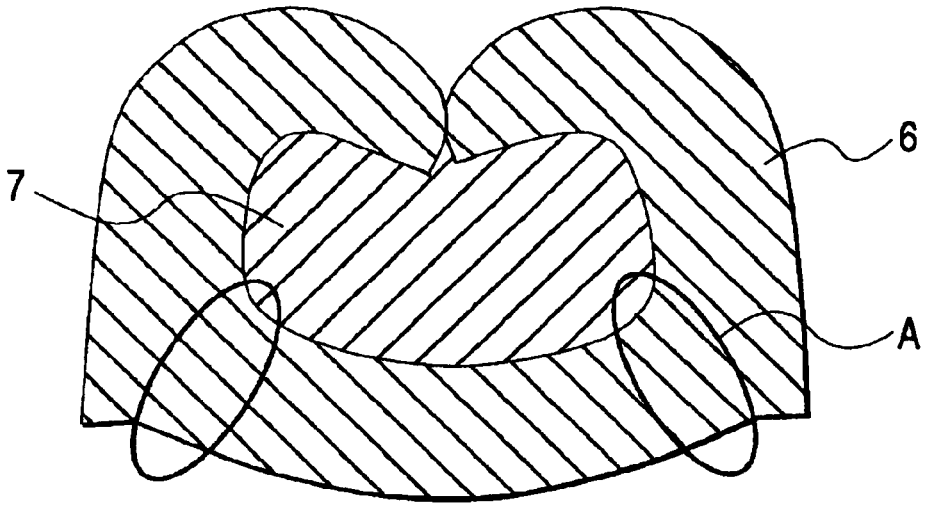
FIG. 3 is a sectional view showing a terminal crimped by the terminal crimping die system of the invention.
Figure 4:
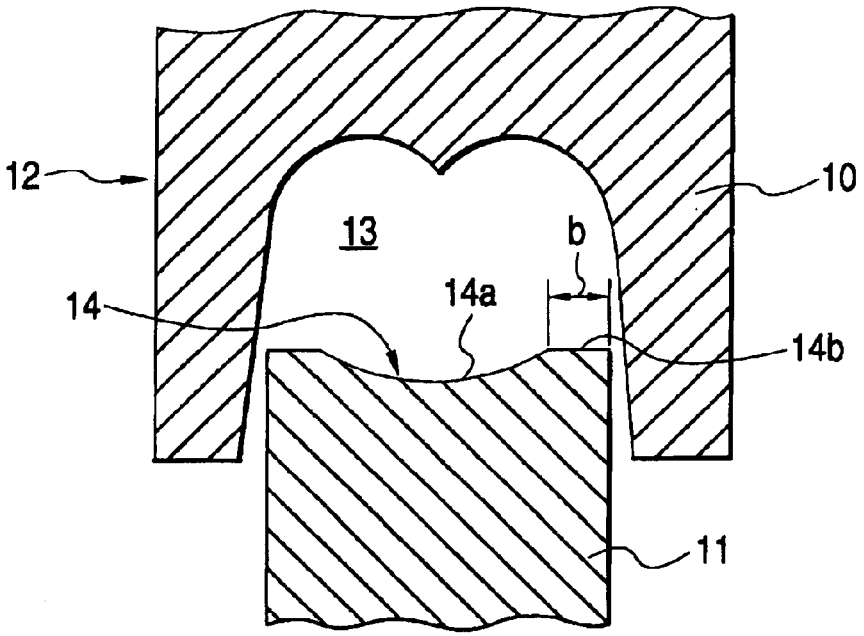
FIG. 4 is a sectional view showing a conventional terminal crimping die system.
Figure 5:
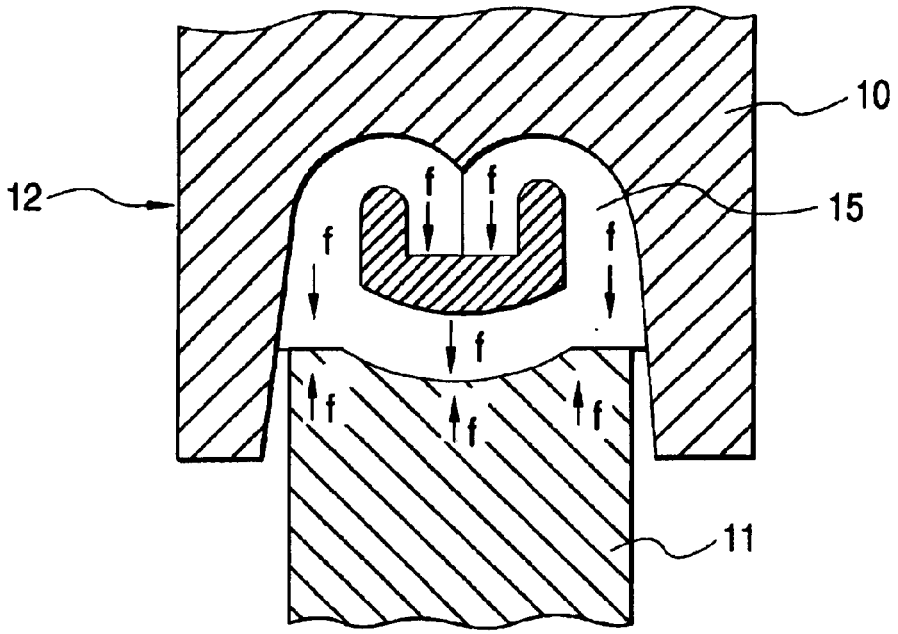
FIG. 5 is a sectional view showing a condition in which a terminal is crimped by the conventional terminal crimping die system.

After the terminal 6 is put thereon, the crimper 3 is downwardly moved. Thus, the terminal 6 is downwardly and upwardly pressed by the crimper 3 and the anvil 4, respectively, during lowering the crimper 3. Each of the crimping pieces 6*a* and 6*a* has a top end, which comes into slide-contact with the guide wall 2*a,* and is gradually and inwardly pushed and bent as the guide wall 2*a* is lowered. Thus, as shown in FIG. 3, the crimping pieces 6*a* and 6*a* enclose the conductors 7 and are crimped and caulked in such a manner as to dig into the conductors 7.

When the terminal 6 is crimped, the caulking force f is generated in each crimping part. The caulking force f generated in the vicinity of the receiving surface 5*b* acts on the receiving surface 5*b*. However, the width a of each of the receiving surfaces 5*b* is equal to or less than ½ of the (plate) thickness of the terminal 6, so that the receiving surfaces 5*b* cannot receive all the caulking force f. The receiving surfaces 5*b* thus receive a part f" of the caulking force. The remaining caulking force f' acts in the direction of the terminal receiving groove 5*a*. Therefore, the caulking force f generated in the vicinity of the receiving surfaces 5*b* is deconcentrated, so that stress is not concentrated on a part of the terminal 6 (that is, the part A shown in FIG. 3). The terminal 6 is favorably crimped to an electric wire.

Practically, each of terminals each having a plate thickness of 0.25 mm was crimped onto an electric wire by using an anvil, which had receiving surfaces, whose widths were 0.10 mm and 0.05 mm. In the case of each of the crimped terminals, stress was not concentrated on the part A. Incidentally, judgments on the presence or absence of stress were made as follows. That is, when a wrinkle was found by a visual inspection, it was decided that the stress was present. Conversely, when no wrinkles were found by a visual inspection, it was decided that the stress was absent.

Figure 6:
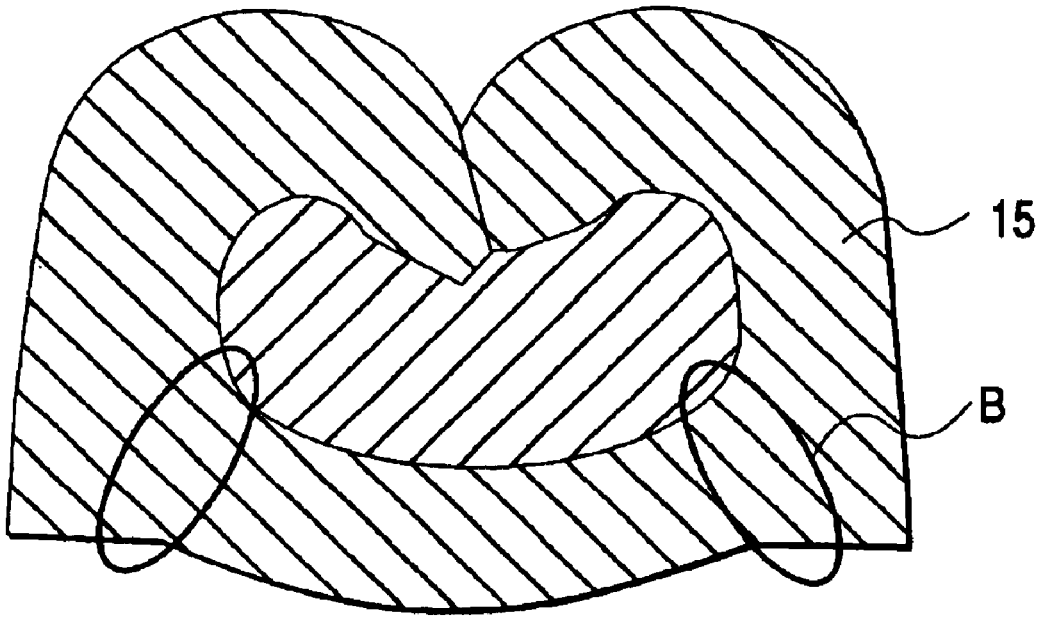
FIG. 6 is a sectional view showing a terminal crimped by the conventional terminal crimping die system.

Further, when each of terminals each having a plate thickness of 0.25 mm was crimped onto an electric wire by using an anvil, which has receiving surfaces, whose widths were 0.20 mm and 0.15 mm, for comparison, stress was concentrated on a part of the terminal (that is, the part B shown in FIG. 6).

Thus, because the width a of each of the receiving surfaces 5*b* of the terminal crimping die system of the invention is not more than ½ of the (plate) thickness of the terminal 6, a part of the caulking force f generated in the vicinity of the receiving surfaces 5*b* acts in the direction of the inside of the terminal receiving groove 5*a* when the terminal 6 is crimped onto an electric wire. Thus, the caulking force f generated in the vicinity of the receiving surfaces 5*b* is deconcentrated. Consequently, the terminal 6 can favorably be crimped to the wire without concentrating stress on the terminal 6. Thus, the electrical connecting performance and the mechanical connecting performance thereof can be enhanced. Moreover, the durability of the terminal 6 can be improved.

As described above, in brief, according to the invention, a terminal can favorably be crimped to an electric wire without concentrating stress on a part of a terminal.

What is claimed is:

1. A terminal crimping die system comprising:

a crimper including a recess; and an anvil provided with a crimping face including a terminal receiving groove and a pair of receiving surfaces, each of which is formed between an end part of the terminal receiving groove and an end part of the crimping face, the anvil being configured to be inserted into the recess of the crimper to thereby crimp and connect a terminal to an electric wire;

wherein a width of each of the receiving surfaces is not more than ½ of a thickness of said terminal.

2. The terminal crimping die system as claimed in claim 1, wherein the width of each of said receiving surfaces range from ⅕ to ⅖ of the thickness of said terminal.

3. A terminal crimping method comprising the steps of:

providing a crimper including a recess and an anvil provided with a crimping face including a terminal receiving groove and a pair of receiving surfaces, each of which is formed between an end part of the terminal receiving groove and an end part of the crimping face;

putting a terminal on the crimping face; and inserting the anvil into the recess of the crimper, so that the terminal is crimped to an electric wire;

wherein a width of each of the receiving surfaces is not more than ½ of a thickness of said terminal.

4. The terminal crimping method as claimed in claim 3, wherein the width of each of said receiving surfaces range from ⅕ to ⅖ of the thickness of said terminal.

5. The terminal crimping die system as claimed in claim 1, wherein a width of one receiving surface of the pair of receiving surfaces is larger than a width of the other receiving surface.

* * * * *